US005890506A

United States Patent [19]

Kupferman

[11] Patent Number: 5,890,506

[45] Date of Patent: Apr. 6, 1999

[54] UMBRELLA AND UMBRELLA CANOPY

[76] Inventor: Glenn Kupferman, 15 Belmond Dr. S., Roslyn Heights, N.Y. 11577

[21] Appl. No.: 804,959

[22] Filed: Feb. 24, 1997

[51] Int. Cl.[6] ..... A45B 25/20

[52] U.S. Cl. ..... 135/33.2; 135/33.7

[58] Field of Search ..... 135/33.2, 33.41, 135/33.7, 33.71

[56] References Cited

U.S. PATENT DOCUMENTS

| | | | |
|---|---|---|---|
| D. 162,617 | 3/1951 | Benivegna | 135/33.7 X |
| 617,415 | 1/1899 | Eatman | 135/33.7 |
| 1,031,974 | 7/1912 | Thomas | 135/33.7 |
| 1,145,768 | 7/1915 | Hartfiel . | |
| 1,785,561 | 12/1930 | Riley . | |
| 2,746,469 | 5/1956 | D'Andrea . | |
| 2,841,160 | 7/1958 | Wispelere | 135/33.71 |
| 3,032,047 | 5/1962 | Wendorf | 135/33.7 |
| 3,456,661 | 7/1969 | Farley | 135/33.7 |
| 3,557,809 | 1/1971 | Vazquez | 135/33.2 X |
| 3,863,660 | 2/1975 | Glaeser | 135/33.7 X |
| 3,892,169 | 7/1975 | Jarnot . | |
| 3,960,162 | 6/1976 | Noel | 135/33.7 |
| 4,865,063 | 9/1989 | Williams | 135/33.7 |
| 4,979,534 | 12/1990 | Johnson et al. | 135/33.41 |

FOREIGN PATENT DOCUMENTS

| | | | |
|---|---|---|---|
| 106457 | 5/1927 | Austria | 135/33.7 |
| 817056 | 8/1937 | France | 135/33.7 |
| 1284022 | 1/1962 | France | 135/33.7 |
| 9140 | 7/1886 | Germany | 135/33.7 |
| 4115467 | 9/1992 | Germany | 135/33.7 |

*Primary Examiner*—Carl D. Friedman
*Assistant Examiner*—Winnie S. Yip
*Attorney, Agent, or Firm*—Ostrolenk, Faber, Gerb & Soffen, LLP

[57] ABSTRACT

An umbrella having a central shaft, a spindle slidably disposed on the shaft and moveably between an upper opening position and a lower closed position, a plurality of first and second radially extending ribs hingedly secured between the shaft t and spindle, an umbrella canopy being supported on the first ribs, the canopy having upper and lower canopy portions, the lower canopy portion having central first and third annular air intransmissible portions disposed at an upper end of the shaft and an outer end of the first radially extending ribs, a second central air transmissible portion disposed between the first and third central air intransmissible portions, the upper canopy portion having an air transmissible material and disposed over the first of the intransmissible. portion around an upper end of the shaft and the second air transmissible portion, and overlapping in part onto the third annular air intransmissible portion, the upper and lower canopy portions being placed under tension and being taut between the pairs of second plurality of extending ribs when the spindle is in a open position such that air impinging on the lower surface of the upper canopy portion being vented through the air transmissible material of the lower canopy portion and then along a channel formed between the upper and lower canopy portions.

33 Claims, 3 Drawing Sheets

UMBRELLA AND UMBRELLA CANOPY

BACKGROUND OF THE INVENTION

The present invention relates to umbrellas, and more particularly, to an umbrella which vents air from its lower concave surface to the upper convex surface. Such a design helps to minimize or prevent damage to the umbrella due to air blasts and particularly, prevents or minimizes annoying umbrella inversion which may occur when the concave side of the umbrella is subjected to a blast of air.

Various umbrella designs, and in particular designs for minimizing the effects of gusts of wind on umbrellas are known. For example, U.S. Pat. No. 3,456,661 to Fairly discloses an umbrella having an upper umbrella covering comprising a plurality of flaps which are disposed over a central opening at the top of the lower umbrella covering. The flaps comprise a plurality of gores secured at their radial edges to the lower umbrella covering along lines defined by radially depending ribs. The gores have dimensions wider than the width between those ribs and taper with increasingly greater width than the width between those ribs. The gores of the Farley design umbrella are accordingly loose fitting and therefore present problems themselves in catching the wind and in presenting a non-traditional umbrella appearance.

U.S. Pat. No. 4,979,534 to Johnston et al. discloses a self described windproof umbrella having a plurality of holes in a first lower umbrella surface and having an overlying smaller umbrella surface which is secured by elastic bands to the ends of the ribs of the umbrella structure. The elastic bands are unattractive and subject to damage. Furthermore, these elastic bands may actually cause umbrella inversion to occur.

Other umbrella designs of interest include U.S. Pat. Nos. 617,415 to Eatman, 3,557,809 to Vasquez, 3,863,660 to Glaeser and 3,960,162 to Noel, Austrian Patent 106,457, U.S. Pat. No. 3,032,047 to Wendorf, French Patent No. 817,056, French Patent No. 1,284,022 and U.S. Pat. No. 1,031,974 to Thomas.

There is a need for an improved umbrella of simple, sturdy design which allows air due to wind impinging on the concave undersurface of the umbrella to escape to minimize the effects of the wind on the umbrella. As is known, a common effect of gusts of wind is an annoying inversion of the umbrella whereby the desired umbrella configuration comprising an upper convex surface and a lower concave surface inverts. In some situations, the wind can also damage the umbrella and cause it to be hurled out of the hands of a holder.

SUMMARY OF THE INVENTION

It is an object of the present invention to provide an improved umbrella which minimizes the effects on the umbrella of gusts of air.

Yet still a further object of the present invention is to provide an improved umbrella which minimizes the tendency of the umbrella to invert due to wind impinging on the lower concave surface of the umbrella.

Yet still a further object of the present invention is to provide a simple, sturdy umbrella which minimizes the effects of the wind and helps to harmlessly vent wind gusts impinging on the concave underside of the umbrella.

The above and other objects of the present invention are achieved by an umbrella comprising a central shaft adapted to be grasped by a user at a first end thereof and having a second end, a spindle slidably disposed on the shaft, the spindle being moveable between a first position adjacent the first end of the shaft and a second position adjacent the second end of the shaft, a first plurality of radially extending ribs secured at first ends thereof hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a central substantially air intransmissible first portion disposed substantially concentrically around the second end of the shaft, a substantially annular second portion having at least one region within the second portion comprising an air transmissible material, the second portion being attached to the central first portion and extending toward the outer perimeter, and a substantially annular and air intransmissible third portion disposed between the second portion and the second ends of the second ribs, the second canopy portion comprising a substantially air intransmissible central second portion disposed over the central first portion and over the air transmissible second portion and overlapping in part onto the substantially annular third portion, the spindle being movable from the first position to the second position to erect the umbrella, the first and second canopy portions being placed under tension when the spindle is in the second position with the first and second canopy portions being taut between respective pairs of the second plurality of ribs, the first canopy portion having a concave lower surface when the umbrella is erected, gusts of air impinging on the lower surface of the first canopy portion being vented through the air transmissible material and then along a channel formed between the first and second canopy portions.

The above and other objects of the invention are also achieved by an umbrella canopy adapted to be disposed over a plurality of radially extending bendable ribs, the ribs having centrally connected first ends and outer second ends, the canopy having an outer perimeter and being secured to the first ends of each of the plurality of ribs at a central portion and being secured at second ends of the plurality of radially extending ribs at the outer perimeter of the canopy, the canopy comprising first and second canopy portions, the first canopy portion comprising a central substantially air intransmissible first portion, a substantially annular second portion having at least one region within the second portion comprising an air transmissible material, the second portion being attached to the central first portion and extending toward the outer perimeter, and a substantially annular and air intransmissible third portion disposed between the second portion and the second ends of the ribs, the second canopy portion comprising a substantially air intransmissible central second portion disposed over the central first portion and over the air transmissible second portion and overlapping in part onto the substantially annular third portion, the first and second canopy portions being placed under tension on the ribs when the umbrella canopy is erected with the first and second canopy portions being taut between respective pairs of the plurality of ribs, the first canopy portion having a concave lower surface when the umbrella is erected, gusts of air impinging on the lower surface of the first canopy portion being vented through the air transmissible material and then along a channel formed between the first and second canopy portions.

The above and other objects of the invention are also achieved by an umbrella comprising a central shaft adapted to be grasped by a user at a first end thereof and having a second end, a spindle slidably disposed on the shaft, the spindle being moveable between a first position adjacent the first end of the shaft and a second position adjacent the second end of the shaft, a first plurality of radially extending ribs secured at first ends thereof hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a central substantially air intransmissible first portion disposed substantially concentrically around the second end of the shaft, a substantially annular second portion comprising at least one region within the second portion having an air transmissible material, the second portion being attached to the central first portion and extending toward the outer perimeter, and a substantially annular and air intransmissible third portion disposed between the second portion and the second ends of the second ribs, the second canopy portion comprising a substantially air intransmissible central second portion disposed over the central first portion and over the air transmissible second portion and overlapping in part onto the substantially annular third portion, the spindle being movable from the first position to the second position to erect the umbrella, the air transmissible material providing support to said second canopy portion to assist in keeping said second canopy portion taut when said umbrella is erected, the first canopy portion having a concave lower surface when the umbrella is erected, gusts of air impinging on the lower surface of the first canopy portion being vented through the air transmissible material and then along a channel formed between the first and second canopy portions.

The above and other objects are also achieved by an umbrella comprising a central shaft adapted to be grasped by a user at a first end thereof and having a second end, a spindle slidably disposed on the shaft, the spindle being moveable between a first position adjacent the first end of the shaft and a second position adjacent the second end of the shaft, a first plurality of radially extending ribs secured at first ends thereof hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a venting portion having at least one region comprising an air transmissible material, the venting portion being attached to a substantially annular and air intransmissible perimeter portion disposed between the venting portion and the second ends of the second ribs, the second canopy portion comprising a substantially air intransmissible central portion disposed over the venting portion and overlapping in part onto the perimeter portion, the spindle being movable from the first position to the second position to erect the umbrella, the first and second canopy portions being placed under tension when the spindle is in the second position with the first and second canopy portions being taut between respective pairs of the second plurality of ribs, the first canopy portion having a concave lower surface when the umbrella is erected, gusts of air impinging on the lower surface of the first canopy portion being vented through the air transmissible material and then along a channel formed between the first and second canopy portions.

The above and other objects of the invention are furthermore achieved by an umbrella canopy adapted to be disposed over a plurality of radially extending bendable ribs, the ribs having centrally connected first ends and outer second ends, the canopy having an outer perimeter and being secured to the first ends of each of the plurality of ribs at a central portion and being secured at second ends of the plurality of radially extending ribs at the outer perimeter of the canopy, the canopy comprising first and second canopy portions, the first canopy portion comprising a venting portion having at least one region comprising an air transmissible material, the venting portion being attached to a substantially annular and air intransmissible perimeter portion disposed between the venting portion and the second ends of the ribs, the second canopy portion comprising a substantially air intransmissible central portion disposed over the venting portion and overlapping in part onto the perimeter portion, the first and second canopy portions being placed under tension on the ribs when the umbrella canopy is erected with the first and second canopy portions being taut between respective pairs of the plurality of ribs, the first canopy portion having a concave lower surface when the umbrella is erected, gusts of air impinging on the lower surface of the first canopy portion being vented through the air transmissible material and then along a channel formed between the first and second canopy portions.

Other features and advantages of the present invention will become apparent from the detailed description which follows.

BRIEF DESCRIPTION OF THE DRAWINGS

The invention will now be described in greater detail in the following detailed description with reference to the drawings in which.

DETAILED DESCRIPTION OF EMBODIMENTS OF THE INVENTION

Figure 1:
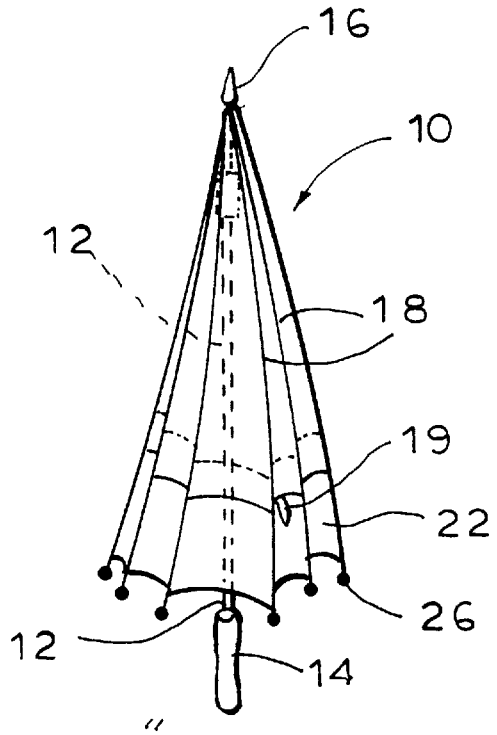
FIG. 1 shows the umbrella according to the invention in an undeployed state as deployment is beginning.
Figure 2:
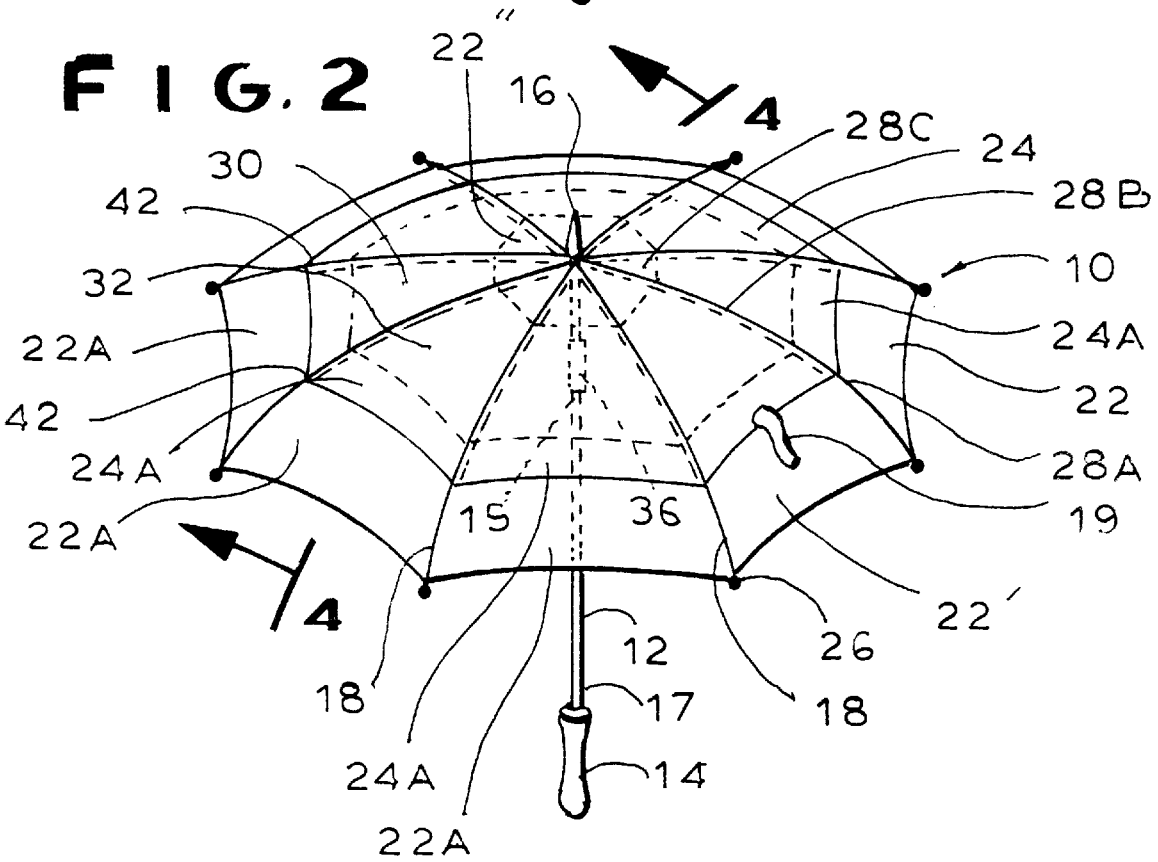
FIG. 2 shows the umbrella according to the present invention in a perspective view from the convex upper surface thereof in a deployed state and partly showing the umbrella canopy in phantom.
Figure 3:
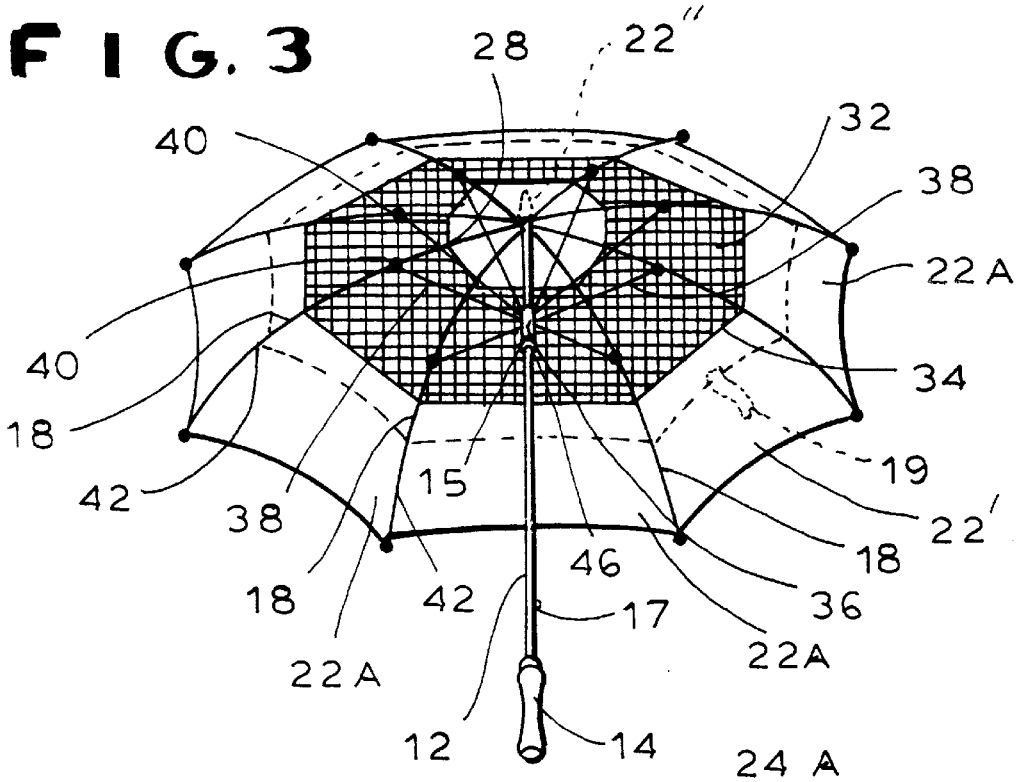
FIG. 3 shows the umbrella viewed from the concave underside thereof, showing the structure of the umbrella and the lower canopy portion thereof.
Figure 5A:
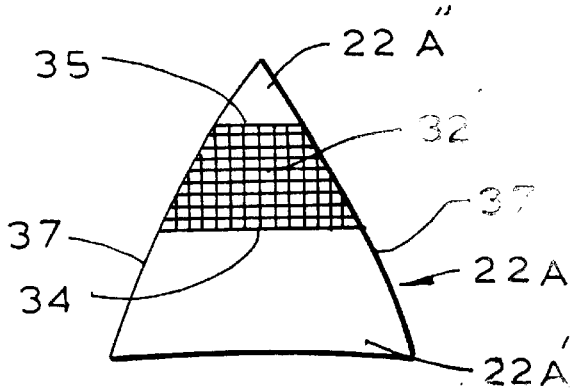
FIG. 5A shows a single gore of the lower canopy portion.

With reference now to the drawings, the umbrella according to the invention is generally designated with the reference numeral 10. The umbrella is shown in FIG. 1 in an undeployed state and in FIGS. 2 and 3 fully deployed. The umbrella comprises a central shaft 12 having a handle 14. The central shaft 12 terminates at an end 16 which may be adorned with a decorative and/or protective final and has a plurality of radially extending ribs 18 hingedly attached at or near the end 16. A flexible, foldable, waterproof covering, for example, a waterproof cloth natural or synthetic covering, such as nylon, is disposed over the plurality of ribs 18 to form the umbrella canopy. The waterproof covering comprises two canopy portions, a lower portion 22 and an upper portion 24 which covers the portion portion 22, at least in part. See, in particular, FIG. 5. The portion 22 includes a plurality of substantially triangular shaped panels or gores 22A (see FIG. 5A) which are appropriately sewn or assembled together to form the canopy portion 22. In conventional fashion, the triangular shaped panels 22A are each sewn or assembled together along lines overlying the ribs 18 to form canopy portion 22. The triangular shaped panels 22A are secured to the ribs 18 at suitable points, in particular, at end points 26 as well as at or near the central top point 16. In addition, the panels 22A may be, and preferably are, secured to the ribs 18 with suitable stitching or bar tacking at intermediary points 28A, 28B and 28C along respective ribs 18. The panels 22A may also be secured to ribs 18 with plastic or metal loops. These loops may have a spring characteristic.

The lower canopy portion 22 comprising the plurality of gores 22A comprises, when sewn together, a substantially air intransmissible annular perimeter portion 22', an air transmissible annular opening 30 and a central upper most substantially air intransmissible portion 22". By "substantially air intransmissible" is meant that the material presents a barrier to wind gusts, i.e., does not allow wind gusts to pass through, even though the material may "breathe" somewhat, or allow some air to permeate through. Conversely, by "substantially air transmissible" is meant that wind gusts can pass through. The substantially annular opening 30 is filled by an air transmissible flexible mesh material 32, for example, of nylon, as shown most clearly in FIGS. 3, 5 and 5A. The mesh is sewn to the material of each portion 22A' of the perimeter portion 22' at a joining line 34, and also sewn to each portion 22A" of the central portion 22" at a joining line 35. Accordingly, each triangular shaped member 22A comprises an upper triangular shaped member 22A", a portion 32' of the mesh material 32 which is essentially formed in the shape of a truncated cone and the lower portion 22A' also shaped in the form of a truncated cone. When the plurality of portions 22A are sewn or otherwise assembled together along radial edges 37, the lower canopy portion 22 is formed.

The mesh material 32 provides an escape route for air gusts impinging on the concave lower surface of the umbrella when it is in a deployed state. The mesh material also provides strength to the entire first canopy portion 22, helping to keep the first canopy portion 22 taut. This is in contrast to some of the prior art designs that have die cut holes in the lower canopy.

Figure 5:
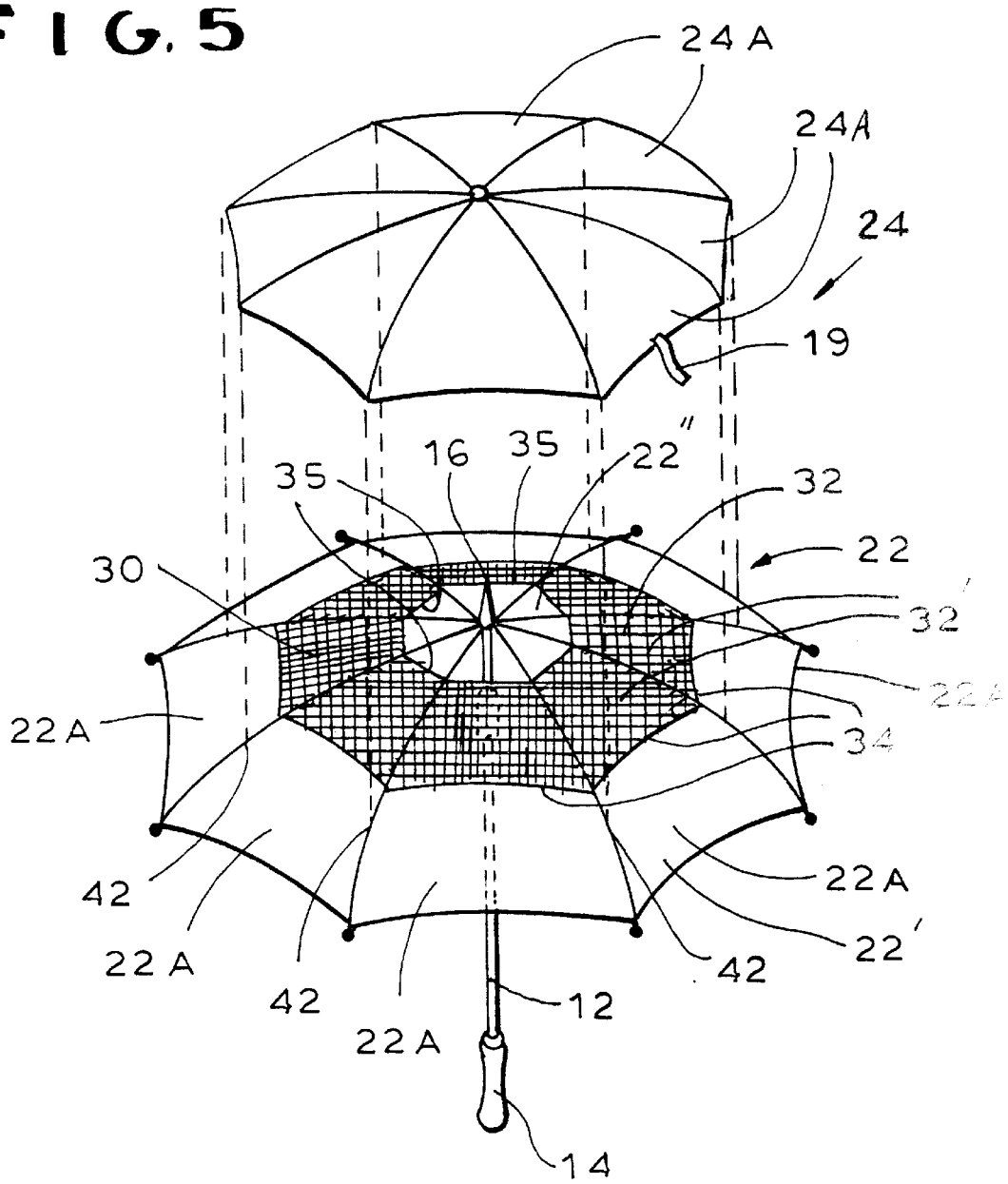
FIG. 5 is an exploded perspective view of the umbrella showing the upper and lower canopy portions thereof disassembled.

The second canopy portion 24 is disposed over the central portion 22" of the first canopy portion 22, the air transmissible portion 30 of the first canopy portion and an overlapped portion of portion 22'. The overlap is necessary to prevent rain water from falling through mesh covered opening 30. Second canopy portion 24 is secured to first canopy portion 22 and ribs 18 at points 42 at the outer perimeter of second canopy portion 24. The second canopy portion 24 comprises a plurality of sewn together triangular shaped gores 24A, as shown in FIG. 5.

The umbrella, in known fashion, includes a spindle 36, slidable on shaft 12, to which spindle 36 radially extending erecting ribs 38 are hingedly attached. See FIG. 3. The ribs 38 are attached to respective ribs 18 by suitable hinges 40 approximately at the mid-section of the ribs 18. The spindle 36 is slidable on the shaft 12, so that the umbrella may be moved to its deployed state shown in FIGS. 2 and 3. As well known to those of skill in the art, the spindle 36 is moved from a position adjacent the handle 14 to the position shown in FIGS. 2 and 3 to deploy the umbrella. When the spindle is moved to the position shown in FIGS. 2 and 3, the ribs 38 move the ribs 18 from the undeployed position shown in FIG. 1 to the deployed position shown in FIG. 3, thereby erecting the umbrella canopy and giving the umbrella a convex upper surface and concave lower surface.

Figure 4:
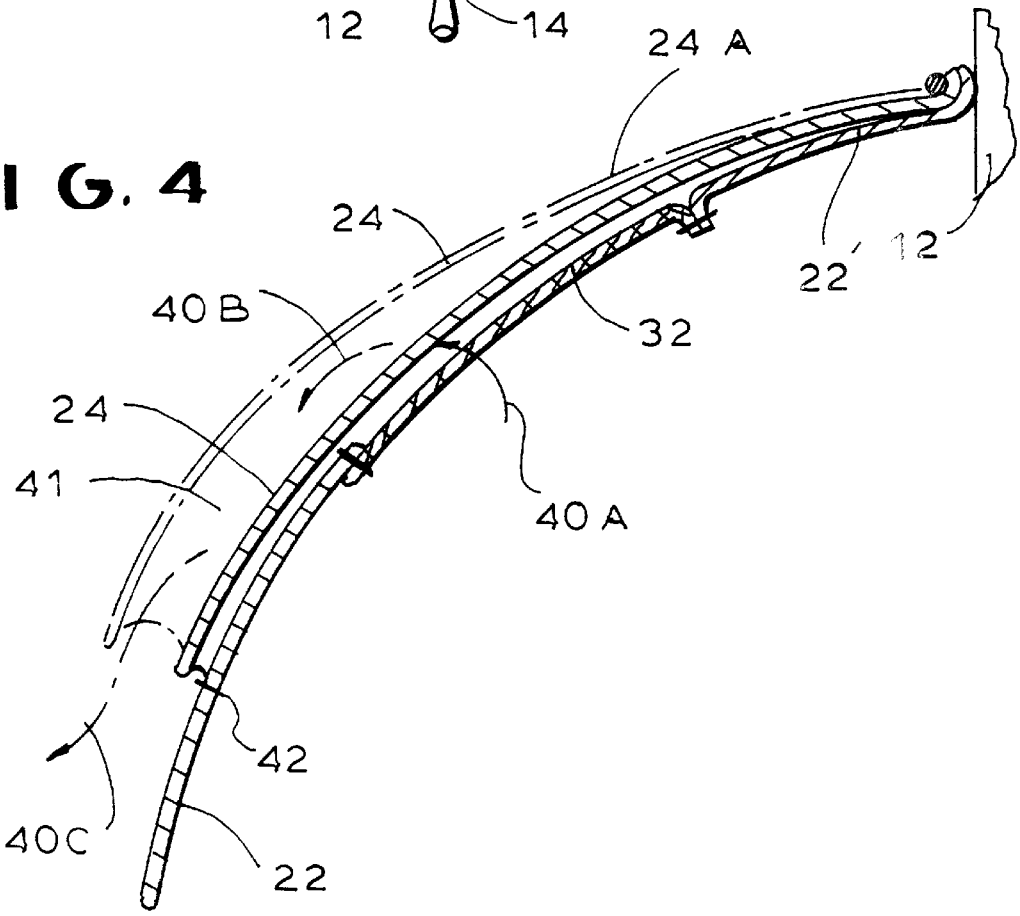
FIG. 4 is a cross-section along lines 4—4 of FIG. 2 showing how gusts of air impinging on the lower concave surface of the umbrella are vented so as to prevent damage to the umbrella.

FIG. 4 shows the way that the umbrella according to the present invention vents air impinging on the concave lower side of the umbrella to the convex upper side. When gusts of air impinge on the lower concave side of the umbrella, the air passes through the mesh material 32, as shown by arrow 40A and bears against the lower surface of the upper canopy portion 24, as shown by arrow 40B. This causes the upper canopy portion 24 to flex upwardly and/or the lower canopy portion to move downwardly, thereby forming a channel 41, venting the air, as indicated by the arrow 40C. The upper canopy portion 24 is provided on the lower canopy portion 22 so that it is substantially taut. The lower canopy portion 22 is likewise substantially taut, and is maintained taut by the presence of mesh 32 in air transmissible portion 30. The upper canopy portion 24 is secured to the ribs 18 at points 42, where the triangular shaped gores 24A of the canopy portion 24 terminate at the lower edges thereof.

The structure of the umbrella according to the present invention provides an aesthetically pleasing design which appears much like a conventional umbrella. The upper canopy portion 24 comprising the triangular shaped panels 24A substantially overlies the lower canopy portion 22 such that it entirely covers the opening 30 filled with mesh material 32 and extends beyond opening 30 in the direction of the perimeter of the umbrella with a substantial overlap, as indicated in the drawings.

By forming the upper canopy portion 24 so that it is substantially taut, when in the deployed state, and substantially as taut as the lower canopy portion 22, the umbrella appears like a traditional umbrella. In addition, the umbrella has substantial strength as a result of the construction described. The mesh material 32 located between the sections 22' and 22" helps to maintain the strength of the lower canopy of the umbrella structure, in contrast to some of the prior art, where holes are provided in the lower covering. According to the preferred embodiment of the invention, the upper canopy portion 24 is substantially as taut as the lower canopy portion 22 when the umbrella is in its deployed state.

Additional features of the invention include a spring loaded locking detent 15 disposed on shaft 12 to define the upper position of spindle 36 and defining the deployed state of the umbrella and a locking detent 17 provided near the handle to lock the umbrella in a closed, undeployed position. Additionally, a tab 19 is provided on the umbrella canopy, preferably on the upper canopy portion 24 and including a suitable fastener, such as a hook and loop type fastener (e.g. Velcro), for securing the umbrella in the undeployed, closed condition by wrapping the tab around the folded umbrella, in known fashion.

The mesh material 32 of the lower canopy portion 22 allows more wind to pass through, in contrast to the prior art designs. The mesh lining 32 also adds stability and rigidity to the lower canopy portion. It also provides a clean finish to the concave underside of the umbrella. Some of the prior art designs utilize die cut vent holes in the covering material of the lower canopy for the wind to pass through. These designs do not utilize a mesh material. This creates a problem because the die cut holes in the covering material, for example, nylon, fray around the edges.

In addition, according to the present invention, the lower canopy 22 is tacked to the upper canopy along the ribs 18. This is done specifically at points 42. This provides for added strength and a clean finished look. The tacking of the lower canopy portion 22 to the upper canopy portion 24 takes flexing pressure off the tip ends 26 of the ribs 18. The ribs 18 may be formed, for example, of fiberglass, metal or suitable bendable plastic. The tacking can be stitching, plastic or metal loops and may also provide a spring characteristic, to aid in wind resistance.

A known prior art design, U.S. Pat. No. 4,979,534, attaches the upper canopy to the lower canopy by using elastic straps, which are attached to the tips of the canopy ribs. The elastic not only gives the umbrella an unfinished appearance, but over time, the elastic will dry out and crack. The elastic, in gusting winds, may also work against the design purpose of the umbrella, causing it to invert. The elastic, which is sewn to the tip ends, may put pressure on the tip ends and may cause the umbrella to invert easier.

The mesh material of the present invention comprises about 35 to 40% of the lower canopy surface area, thus improving air flow. Some of the prior art designs utilize about less than 20% of the lower canopy portion for air flow. This is in particular true of such designs employing die cut holes. Accordingly, the present invention has significantly greater airflow than the prior art designs. The greater the surface area of the mesh material, the greater amount of air which will flow, thereby preventing the umbrella from inverting.

An additional advantage of the invention from a manufacturing standpoint is that the mesh portions 32' are easier to sew along the panel seams. The mesh will keep all the panels of the umbrella uniform, giving it a clean finish and a quality appearance.

In the prior art, the use of die cut holes in the lower canopy portion causes problems. For example, when die cutting the holes, the covering material, generally nylon, is stacked about 20 to 40 pieces high. This will cause some of the panels to shift during the cutting process. The shifting will cause the vent holes to be die cut off center and result in uneven assembly when the panels are sewn together. Furthermore, the cost factor of the mesh material as compared to die cut vent holes after waste of unevenly die cut panels is less than the cost of die cutting the vent holes.

In addition, the mesh panels are also more rigid, making it easier to sew them than panels with die cut vent holes.

Although the umbrella and umbrella canopy according to the invention preferably provide the portion 30 so that substantially the entire portion 30 comprises air transmissible mesh material 32, the region 30 may also be provided with openings not covering the entire region 30, with the openings in the region 30 being fitted with air transmissible material such as mesh material 32.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An umbrella comprising:

a central shaft adapted to be grasped by a user at a first end thereof and having a second end;

a spindle slidably disposed on the shaft, the spindle being moveable between a first position adjacent the first end of the shaft and a second position adjacent the second end of the shaft, a first plurality of radially extending ribs secured at first ends of each of the first plurality of radially extending ribs hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a central substantially air intransmissible first portion disposed substantially concentrically around the second end of the shaft, a substantially annular second portion having at least one region within the second portion comprising an air transmissible material, the second portion being attached to the central first portion and extending toward the outer perimeter, and a substantially annular and air intransmissible third portion disposed between the second portion and the second ends of the second ribs, the second canopy portion comprising a substantially air intransmissible central second portion disposed over the central first portion and over the air transmissible second portion and overlapping in part onto the substantially annular third portion, the spindle being movable from the first position to the second position to erect the umbrella, inelastic tack means being provided to tack the second canopy portion to the first canopy portion and to secure the first and second canopy portions to each of the second plurality of ribs to thereby cause the first and second canopy portions to become taut and under tension between respective pairs of the second plurality of ribs when the spindle is in the second position; the first canopy portion having a concave lower surface when the umbrella is erected, gusts of air impinging on the lower surface of the first canopy portion being vented through the air transmissible material and then along a channel formed between the first and second canopy portions.

2. The umbrella of claim 1, wherein the air transmissible material comprises a mesh material.

3. The umbrella of claim 2, wherein said mesh material comprises substantially all of said second portion of said first canopy portion.

4. The umbrella of claim 1, wherein the air transmissible material provides support to said second canopy portion to assist in keeping said second canopy portion taut when said umbrella is erected.

5. The umbrella of claim 1, wherein the first canopy portion comprises a plurality of substantially triangular panels assembled together.

6. The umbrella of claim 5, wherein each substantially triangular panel comprises a substantially truncated cone shaped perimeter section forming a part of said third portion, a substantially truncated cone shaped middle section forming a part of said air transmissible second portion and a substantially triangular shaped top section forming a part of said central first portion.

7. The umbrella of claim 5, wherein the perimeter, middle and top sections are sewn together to form each substantially triangular panels, and one triangular panels are sewn together to form the first canopy portion.

8. The umbrella of claim 1, wherein the second canopy portion comprises a plurality of substantially triangular panels assembled together.

9. The umbrella of claim 8, wherein the substantially triangular panels of the second canopy portion are assembled together to form the second canopy portion.

10. The umbrella of claim 1, wherein the second canopy portion has an outer perimeter, the second canopy portion being attached to the first canopy portion at selected points at the outer perimeter.

11. The umbrella of claim 10, wherein the selected points overly respective ones of the second ribs at positions overlying said annular third portion of the first canopy portion.

12. The umbrella of claim 1, wherein the first canopy portion is attached at selected points to said second ribs.

13. An umbrella canopy adapted to be disposed over a plurality of radially extending bendable ribs, the ribs having centrally connected first ends and outer second ends, the canopy having an outer perimeter and adapted to be secured to the first ends of each of the plurality of ribs at a central portion and adapted to be secured at second ends of the plurality of radially extending ribs at the outer perimeter of the canopy, the canopy comprising first and second canopy portions, the first canopy portion comprising a central substantially air intransmissible first portion, a substantially annular second portion having at least one region within the second portion comprising an air transmissible material, the second portion being attached to the central first portion and extending toward the outer perimeter, and a substantially annular and air intransmissible third portion disposed between the second portion and the outer perimeter, the second canopy portion comprising a substantially air intransmissible central second portion disposed over the central first portion and over the air transmissible second portion and overlapping in part onto the substantially annular third portion, inelastic tack means being provided to tack the second canopy portion to the first canopy portion and to secure the first and second canopy portions to each of the plurality of ribs to thereby cause the first and second canopy portions to become taut and under tension between respective pairs of the plurality of ribs when the umbrella canopy is erected; the first canopy portion having a concave lower surface when the umbrella is erected, gusts of air impinging on the lower surface of the first canopy portion being vented through the air transmissible material and then along a channel formed between the first and second canopy portions.

14. The umbrella canopy of claim 13, wherein the air transmissible material comprises a mesh material.

15. The umbrella canopy of claim 14, wherein said mesh material comprises substantially all of said air transmissible second portion.

16. The umbrella canopy of claim 13, wherein the air transmissible material provides support to said second canopy portion to assist in keeping said second canopy portion taut when said umbrella is erected.

17. The umbrella canopy of claim 13, wherein the first canopy portion comprises a plurality of substantially triangular panels assembled together.

18. The umbrella canopy of claim 17, wherein each substantially triangular panel comprises a substantially truncated cone shaped perimeter section forming a part of said third portion, a substantially truncated cone shaped middle section forming a part of said air transmissible second portion and a substantially triangular shaped top section forming a part of said central first portion.

19. The umbrella canopy of claim 18, wherein the perimeter, middle and top sections are assembled together to form each substantially triangular panel, and the triangular panels are sewn together to form the first canopy portion.

20. The umbrella canopy of claim 13, wherein the second canopy portion comprises a plurality of substantially triangular panels assembled together.

21. The umbrella canopy of claim 20, wherein the substantially triangular panels of the second canopy portion are assembled together to form the second canopy portion.

22. The umbrella canopy of claim 13, wherein the second canopy portion has an outer perimeter, the second canopy portion being attached to the first canopy portion at selected points at the outer perimeter.

23. The umbrella canopy of claim 22, wherein the selected points overly respective ones of the ribs at positions overlying said annular third portion of the first canopy portion.

24. The umbrella canopy of claim 13, wherein the first canopy portion is adapted to be attached at selected points to said ribs.

25. An umbrella comprising:

a central shaft adapted to be grasped by a user at a first end thereof and having a second end;

a spindle slidably disposed on the shaft, the spindle being moveable between a first position adjacent the first end of the shaft and a second position adjacent the second end of the shaft, a first plurality of radially extending ribs secured at first ends of each of the first plurality of radially extending ribs hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a central substantially air intransmissible first portion disposed substantially concentrically around the second end of the shaft, a substantially annular second portion comprising at least one region within the second portion having an air transmissible material, the second portion being attached to the central first portion and extending toward the outer perimeter, and a substantially annular and air intransmissible third portion disposed between the second portion and the second ends of the second ribs, the second canopy portion comprising a substantially air intransmissible central second portion disposed over the central first portion and over the air transmissible second portion and overlapping in part onto the substantially annular third portion, the spindle being movable from the first position to the second position to erect the umbrella, the air transmissible material providing support to said second canopy portion to assist in keeping said second canopy portion taut when said umbrella is erected, inelastic tack means being provided to tack the second canopy portion to the first canopy portion and to secure the first and second canopy portions to each of the second plurality of ribs to thereby cause the first and second canopy portions to become taut and under tension between respective pairs of the second plurality of ribs when the spindle is in the second position; the first canopy portion having a concave lower surface when the umbrella is erected, gusts of air impinging on the lower surface of the first canopy portion being vented through the air transmissible material and then along a channel formed between the first and second canopy portions.

26. An umbrella comprising:

a central shaft adapted to be grasped by a user at a first end thereof and having a second end;

a spindle slidably disposed on the shaft, the spindle being moveable between a first position adjacent the first end of the shaft and a second position adjacent the second end of the shaft, a first plurality of radially extending ribs secured at first ends of each of the first plurality of radially extending ribs hingedly to the spindle, the first radially extending ribs being secured at second ends thereof to respective ones of a second plurality of radially extending ribs, the second plurality of radially extending ribs being hingedly connected to the second end of the shaft at first ends of the second ribs and extending from the second end of the shaft and terminating at second ends, the second plurality of ribs supporting an umbrella canopy, the canopy having an outer perimeter and being secured at the first ends of each of the second plurality of ribs adjacent the second end of the shaft and being secured at the second ends of the second plurality of radially extending ribs at the outer perimeter of the canopy, the canopy comprising first and second canopy portions, the first canopy portion comprising a venting portion having at least one region comprising an air transmissible material, the venting portion being attached to a substantially annular and air intransmissible perimeter portion disposed between the venting portion and the second ends of the second ribs, the second canopy portion comprising a substantially air intransmissible central portion disposed over the venting portion and overlapping in part onto the perimeter portion, the spindle being movable from the first position to the second position to erect the umbrella, inelastic tack means being provided to tack the second canopy portion to the first canopy portion and to secure the first and second canopy portions to each of the second plurality of ribs to thereby cause the first and second canopy portions to become taut and under tension between respective pairs of the second plurality of ribs when the spindle is in the second position; the first canopy portion having a concave lower surface when the umbrella is erected, gusts of air impinging on the lower surface of the first canopy portion being vented through the air transmissible material and then along a channel formed between the first and second canopy portions.

27. The umbrella of claim 26, further wherein the first canopy portion includes a central portion concentric with the shaft disposed between the shaft and the venting portion.

28. The umbrella of claim 26, wherein the air transmissible material comprises a mesh material.

29. The umbrella of claim 26, wherein the air transmissible material provides support to said second canopy portion to assist in keeping said second canopy portion taut when said umbrella is erected.

30. An umbrella canopy adapted to be disposed over a plurality of radially extending bendable ribs, the ribs having centrally connected first ends and outer second ends, the canopy having an outer perimeter and adapted to be secured to the first ends of each of the plurality of ribs at a central portion and adapted to be secured at second ends of the plurality of radially extending ribs at the outer perimeter of the canopy, the canopy comprising first and second canopy portions, the first canopy portion comprising a venting portion having at least one region comprising an air transmissible material, the venting portion being attached to a substantially annular and air intransmissible perimeter portion disposed between the venting portion and the outer perimeter, the second canopy portion comprising a substantially air intransmissible central portion disposed over the venting portion and overlapping in part onto the perimeter portion, inelastic tack means being provided to tack the second canopy portion to the first canopy portion and to secure the first and second canopy portions to each of the plurality of ribs to thereby cause the first and second canopy portions to become taut and under tension between respective pairs of the ribs when the umbrella canopy is erected; the first canopy portion having a concave lower surface when the umbrella is erected, gusts of air impinging on the lower surface of the first adapted to be held portion being vented through the air transmissible material and then along a channel formed between the first and second canopy portions.

31. The umbrella canopy of claim 30, further wherein the first canopy portion includes a central portion concentric with the shaft disposed between the shaft and the venting portion.

32. The umbrella canopy of claim 30, wherein the air transmissible material comprises a mesh material.

33. The umbrella canopy of the claim 30, wherein the air transmissible material provides support to said second canopy portion to assist in keeping said second canopy portion taut when said umbrella is erected.

* * * * *

UNITED STATES PATENT AND TRADEMARK OFFICE

CERTIFICATE OF CORRECTION

PATENT NO. : 5,890,506

DATED : April 6, 1999

INVENTOR(S) : Glenn KUPFERMAN

It is certified that error appears in the above-indentified patent and that said Letters Patent is hereby corrected as shown below:

On the title page, item: "[76] Inventor"; change "Belmond" to --Belmont--.

Signed and Sealed this

Thirty-first Day of October, 2000

*Attest:*

*Attesting Officer*

Q. TODD DICKINSON

*Director of Patents and Trademarks*